US010995726B2

(12) United States Patent
Petruska et al.

(10) Patent No.: US 10,995,726 B2
(45) Date of Patent: May 4, 2021

(54) CURRENT PROFILE OPTIMIZATION

(71) Applicant: Woodward, Inc., Fort Collins, CO (US)

(72) Inventors: David C. Petruska, Fort Collins, CO (US); Sai Venkataramanan, Fort Collins, CO (US); Suraj Nair, Fort Collins, CO (US); Mark Notarfrancesco, Fort Collins, CO (US); Monte Wegner, Bellvue, CO (US); Andy Vlietstra, Fort Collins, CO (US)

(73) Assignee: Woodward, Inc., Fort Collins, CO (US)

( * ) Notice: Subject to any disclaimer, the term of this patent is extended or adjusted under 35 U.S.C. 154(b) by 201 days.

(21) Appl. No.: 15/940,366

(22) Filed: Mar. 29, 2018

(65) Prior Publication Data

US 2019/0301423 A1 Oct. 3, 2019

(51) Int. Cl.
*F02P 17/12* (2006.01)
*F02P 17/10* (2006.01)
(Continued)

(52) U.S. Cl.
CPC ..... *F02P 17/12* (2013.01); *F02P 3/0456* (2013.01); *F02P 3/053* (2013.01); *F02P 3/0869* (2013.01);
(Continued)

(58) Field of Classification Search
CPC ..... F02P 3/0456; F02P 5/1506; F02P 17/10; F02P 17/12; F02P 3/0869; F02P 3/053;
(Continued)

(56) References Cited

U.S. PATENT DOCUMENTS 4,377,140 A 3/1983 Latsch
5,043,900 A 8/1991 Allen et al.
(Continued)

FOREIGN PATENT DOCUMENTS

EP 2873850 5/2015
EP 3276156 1/2018
(Continued)

OTHER PUBLICATIONS

PCT Invitation to Pay Additional Fees in International Application No. PCT/US2019/023204, dated Jun. 13, 2019, 16 pages.
(Continued)

*Primary Examiner* — Sizo B Vilakazi
(74) *Attorney, Agent, or Firm* — Fish & Richardson P.C.

(57) ABSTRACT

The subject matter of this specification can be embodied in, among other things, a method that includes receiving a collection of measurements of electric current amplitude in a primary winding of an engine ignition system having the primary winding and a spark plug, identifying an ignition start time, identifying an inflection point based on the plurality of measurements, determining an inflection point time representative of a time at which the identified inflection point occurred, determining a spark start time based on an amount of time between the ignition start time and the inflection point time, and providing a signal indicative of the spark start time.

33 Claims, 5 Drawing Sheets

(51) Int. Cl.

| | |
|---|---|
| ***F02P 3/045*** | (2006.01) |
| ***F02P 3/08*** | (2006.01) |
| ***F02P 3/05*** | (2006.01) |
| ***F02P 5/15*** | (2006.01) |
| *F02P 9/00* | (2006.01) |
| *F02P 15/08* | (2006.01) |
| *F02P 17/02* | (2006.01) |
| *F02P 3/01* | (2006.01) |
| *F02P 11/06* | (2006.01) |

(52) U.S. Cl.
CPC ..... *F02P 5/1506* (2013.01); *F02P 17/10* (2013.01); *F02P 3/01* (2013.01); *F02P 3/0853* (2013.01); *F02P 3/0876* (2013.01); *F02P 9/002* (2013.01); *F02P 11/06* (2013.01); *F02P 15/08* (2013.01); *F02P 17/02* (2013.01); *F02P 2017/121* (2013.01); *F02P 2017/123* (2013.01); *F02P 2017/128* (2013.01)

(58) Field of Classification Search
CPC .. F02P 11/06; F02P 17/02; F02P 15/08; F02P 3/01; F02P 2017/121; F02P 2017/128; F02P 3/0853; F02P 3/0876; F02P 2017/123; F02P 9/002
See application file for complete search history.

(56) References Cited

U.S. PATENT DOCUMENTS

| | | | | |
|---|---|---|---|---|
| 6,131,555 | A | 10/2000 | Tozzi et al. | |
| 6,615,645 | B1 * | 9/2003 | Butler, Jr. ..... | F02P 17/12 73/114.08 |
| 6,883,508 | B2 | 4/2005 | Geoffroy | |
| 8,718,900 | B2 | 5/2014 | Schoen | |
| 9,086,046 | B2 | 7/2015 | Kajita et al. | |
| 9,353,723 | B2 | 5/2016 | Bengtsson et al. | |
| 9,388,786 | B2 | 7/2016 | Nakano | |
| 9,765,750 | B2 | 9/2017 | Ferguson et al. | |
| 9,771,918 | B2 | 9/2017 | Nakayama et al. | |
| 2010/0006066 | A1 * | 1/2010 | Danne ..... | F02P 3/0453 123/406.26 |
| 2011/0264269 | A1 * | 10/2011 | Chodacki ..... | F23Q 7/26 700/274 |
| 2012/0247441 | A1 | 10/2012 | Schultz | |
| 2017/0045025 | A1 | 2/2017 | Nakayama et al. | |
| 2017/0314524 | A1 * | 11/2017 | Hoban ..... | F02P 17/12 |
| 2018/0038335 | A1 | 2/2018 | Kaori et al. | |
| 2018/0306163 | A1 | 10/2018 | Rezaei | |

FOREIGN PATENT DOCUMENTS

| | | |
|---|---|---|
| WO | WO2007038945 | 4/2007 |
| WO | WO2015179095 | 11/2015 |
| WO | WO2016001968 A1 | 1/2016 |

OTHER PUBLICATIONS

PCT International Search Report and Written Opinion in International Application No. PCT/US2019/023204, dated Oct. 24, 2019, 23 pages.
PCT International Preliminary Report on Patentability in International Appln. No. PCT/US2019/023204, dated Oct. 8, 2020, 15 pages.

* cited by examiner

CURRENT PROFILE OPTIMIZATION

TECHNICAL FIELD

This instant specification relates to determining the response of spark plugs for internal combustion engines.

BACKGROUND

Spark plugs are used to create electric sparks in the combustion chambers of an internal combustion engine to ignite a compressed fuel/air mixture. Spark plugs typically have a metal threaded shell and a ceramic insulating layer that electrically isolates the shell from a central electrode. The central electrode extends through the ceramic insulator into the combustion chamber. A spark gap is defined between the inner end of the central electrode and the threaded shell.

Spark plugs are typically connected to a high voltage generated by an ignition coil connected to an ignition driver. A voltage is developed between the central electrode and the threaded shell as current flows from the coil. Initially, the fuel and air in the spark gap act as an insulator, preventing current flow. As the voltage continues to rise, the structure of the gases between the electrodes begins to change and the gases become ionized once the voltage exceeds the dielectric strength of the gases. The ionized gas is electrically conductive and allows current to flow across the gap.

Voltage ranges of 12,000-25,000 volts are typically used to cause the spark plug to spark (or "fire") properly, but higher voltages (e.g., up to 45,000 volts) can be used as well. By supplying higher currents during the discharge process, sparks that are hotter and have a longer duration can be created. The voltages used can vary depending on a number of engine operating conditions, such as fuel quality, cylinder compression levels, spark gap, engine loading, extender material, cylinder head dimensions, and gas turbulence levels in the cylinder.

SUMMARY

In general, this document describes systems and techniques for determining the response of spark plugs for internal combustion engines.

In a first aspect, a method includes receiving a collection of measurements of electric current amplitude in a primary winding of an engine ignition system having the primary winding and a spark plug, identifying an ignition start time, identifying an inflection point based on the collection of measurements, determining an inflection point time representative of a time at which the identified inflection point occurred, determining a spark start time based on an amount of time between the ignition start time and the inflection point time, and providing a signal indicative of the spark start time.

Various implementations can include some, all, or none of the following features. The method can include sensing, by an electric current sensor, the collection of measurements. The method can include determining a spark plug breakdown voltage based on the spark start time, and providing a signal indicative of the spark plug breakdown voltage. The method can include providing a first amount of energy to the primary winding, wherein the ignition start time corresponds to the start of providing the first amount of energy, determining a second amount of energy based on the spark start time that is different from the first amount of energy, providing the second amount of energy to the primary winding, and sparking the spark plug based on the second amount of energy. The second amount of energy can be less than the first amount of energy. The method can also include determining that the spark start time has exceeded a predetermined threshold time value, and provide a signal indicative of a condition in which the spark plug is to be replaced. The method can include identifying a second inflection point based on the collection of measurements, determining that a spark developed by the spark plug has been extinguished based on the second inflection point, and provide an extinguishment signal indicative of a condition in which the spark plug spark has been extinguished. The method can include providing an amount of energy to the primary winding in response to the extinguishment signal, and re-sparking the spark plug based on the amount of energy. The method can include identifying a second inflection point based on the collection of measurements, determining that an end of spark event has occurred based on the second inflection point, and provide an end of spark signal indicative of a condition in which the spark plug spark has been extinguished. Identifying an inflection point based on the collection of measurements can include determining a first rate of change in electric current amplitude in the primary winding, determining a second rate of change in electric current amplitude in the primary winding that is adjacent to and different from the first rate of change, identifying a transition point based on the collection of measurement where the first rate of change meets the second rate of change, and providing the identified transition point as the inflection point.

In a second aspect, an ignition controller includes an input, an output, memory storing instructions that are executable, and one or more processing devices to execute the instructions to perform operations including receiving, at the input, a collection of measurements of electric current amplitude in a primary winding of an engine ignition system having the primary winding and a spark plug, identifying an ignition start time, identifying an inflection point based on the collection of measurements, determining an inflection point time representative of a time at which the identified inflection point occurred, determining a spark start time based on an amount of time between the ignition start time and the inflection point time, and providing, at the output, a signal indicative of the spark start time.

Various embodiments can include some, all, or none of the following features. The operations can include sensing, by an electric current sensor, the collection of measurements. The operations can include determining a spark plug breakdown voltage based on the spark start time, and providing a signal indicative of the spark plug breakdown voltage. The operations can include providing a first amount of energy to the primary winding, wherein the ignition start time corresponds to the start of providing the first amount of energy, determining a second amount of energy based on the spark start time that is different from the first amount of energy, providing the second amount of energy to the primary winding, and sparking the spark plug based on the second amount of energy. The second amount of energy can be less than the first amount of energy. The operations can include determining that the spark start time has exceeded a predetermined threshold time value, and provide a signal indicative of a condition in which the spark plug is to be replaced. The operations can include identifying a second inflection point based on the collection of measurements, determining that a spark developed by the spark plug has been extinguished based on the second inflection point, and provide an extinguishment signal indicative of a condition in which the spark plug spark has been extinguished. The operations can include providing an amount of energy to the primary winding in response to the extinguishment signal, and re-sparking the spark plug based on the amount of energy. The operations can include identifying a second inflection point based on the collection of measurements, determining that an end of spark event has occurred based on the second inflection point, and provide an end of spark signal indicative of a condition in which the spark plug spark has been extinguished. Identifying an inflection point based on the collection of measurements can include determining a first rate of change in electric current amplitude in the primary winding, determining a second rate of change in electric current amplitude in the primary winding that is adjacent to and different from the first rate of change, identifying a transition point based on the collection of measurement where the first rate of change meets the second rate of change, and providing the identified transition point as the inflection point.

In a third aspect, an engine system includes an engine, an engine ignition system comprising a primary winding and a spark plug, and an ignition controller having an input, an output, memory storing instructions that are executable, and one or more processing devices to execute the instructions to perform operations including receiving, at the input, a collection of measurements of electric current amplitude in a primary winding of an engine ignition system having the primary winding and a spark plug, identifying an ignition start time, identifying an inflection point based on the collection of measurements, determining an inflection point time representative of a time at which the identified inflection point occurred, determining a spark start time based on an amount of time between the ignition start time and the inflection point time, and providing, at the output, a signal indicative of the spark start time.

Various embodiments can include some, all, or none of the following features. The operations can include sensing, by an electric current sensor, the collection of measurements. The operations can include determining a spark plug breakdown voltage based on the spark start time, and providing a signal indicative of the spark plug breakdown voltage. The operations can include providing a first amount of energy to the primary winding, wherein the ignition start time corresponds to the start of providing the first amount of energy, determining a second amount of energy based on the spark start time that is different from the first amount of energy, providing the second amount of energy to the primary winding, and sparking the spark plug based on the second amount of energy. The second amount of energy can be less than the first amount of energy. The operations can include determining that the spark start time has exceeded a predetermined threshold time value, and provide a signal indicative of a condition in which the spark plug is to be replaced. The operations can include identifying a second inflection point based on the collection of measurements, determining that a spark developed by the spark plug has been extinguished based on the second inflection point, and provide an extinguishment signal indicative of a condition in which the spark plug spark has been extinguished. The operations can include providing an amount of energy to the primary winding in response to the extinguishment signal, and re-sparking the spark plug based on the amount of energy. The operations can include identifying a second inflection point based on the collection of measurements, determining that an end of spark event has occurred based on the second inflection point, and provide an end of spark signal indicative of a condition in which the spark plug spark has been extinguished. Identifying an inflection point based on the collection of measurements can include determining a first rate of change in electric current amplitude in the primary winding, determining a second rate of change in electric current amplitude in the primary winding that is adjacent to and different from the first rate of change, identifying a transition point based on the collection of measurement where the first rate of change meets the second rate of change, and providing the identified transition point as the inflection point.

The systems and techniques described here may provide one or more of the following advantages. First, a system can reduce the amount of power used to power an ignition system. Second, the system can reduce spark plug erosion. Third, the system can increase spark plug life. Fourth, the system can increase the operational availability of combustion engines. Fifth, the system can reduce maintenance costs for combustion engines. Sixth, the system can increase the fuel efficiency of combustion engines.

The details of one or more implementations are set forth in the accompanying drawings and the description below. Other features and advantages will be apparent from the description and drawings, and from the claims.

DETAILED DESCRIPTION

In general, this document describes systems and techniques for determining the response of spark plugs for internal combustion engines. A challenge in spark plug design is premature spark plug wear. Premature spark plug wear is caused by high temperatures. Spark plug electrodes erode with use and this erosion can be accelerated by the use of excessively hot sparks. Accelerated electrode erosion reduces the number of operational hours that the spark plug can operate before it needs to be replaced. Such wear can lead to excessive and/or unscheduled downtime for the engine and therefore increased operational costs for the engine operator.

Legacy methods used for estimating the spark plug breakdown voltage generally measure the total time required to reach a pre-determined primary current value. In such legacy systems there exists a pre-breakdown or pre-inflection current with low primary ignition coil current slope (e.g., low di/dt) and a post breakdown or post inflection point current with high primary coil current slope (i.e., high di/dt). Such legacy systems generally infer breakdown voltage by measuring the time required to reach a pre-determined primary winding current value that is generally higher than the primary winding inflection point current. Such pre-determined primary winding current values are selected such that voltage breakdown ensured for all spark plug operating conditions. The pre-determined current values of such legacy systems are greater than are needed for many breakdown voltage operating points, especially for fresh spark plugs that exhibit a small gap. This means that for many legacy breakdown voltage operating points, the selected primary currents are much greater than are needed in order to generate ionization. Such excessive current levels can lead to excessive and/or premature spark plug wear.

Generally speaking, the systems and techniques described in this document monitor the current that is provided to an ignition system, coil, and spark plug, and detect one or more events (e.g., primary ignition coil current inflection points) that can be used to determine the time and/or estimate the voltage at the start and/or end of a spark. This information can be used to modify the amount of energy that is provided to the spark plug, for example, to reduce the temperature of the sparks and reduce the amount of spark plug wear that results from the use of excessively hot sparks and/or electron depletion from the electrodes. This monitoring process can also be used to detect the end of sparks and the occurrence of spark blowout, and this information can be used to modify ignition system performance and life.

Figure 1:
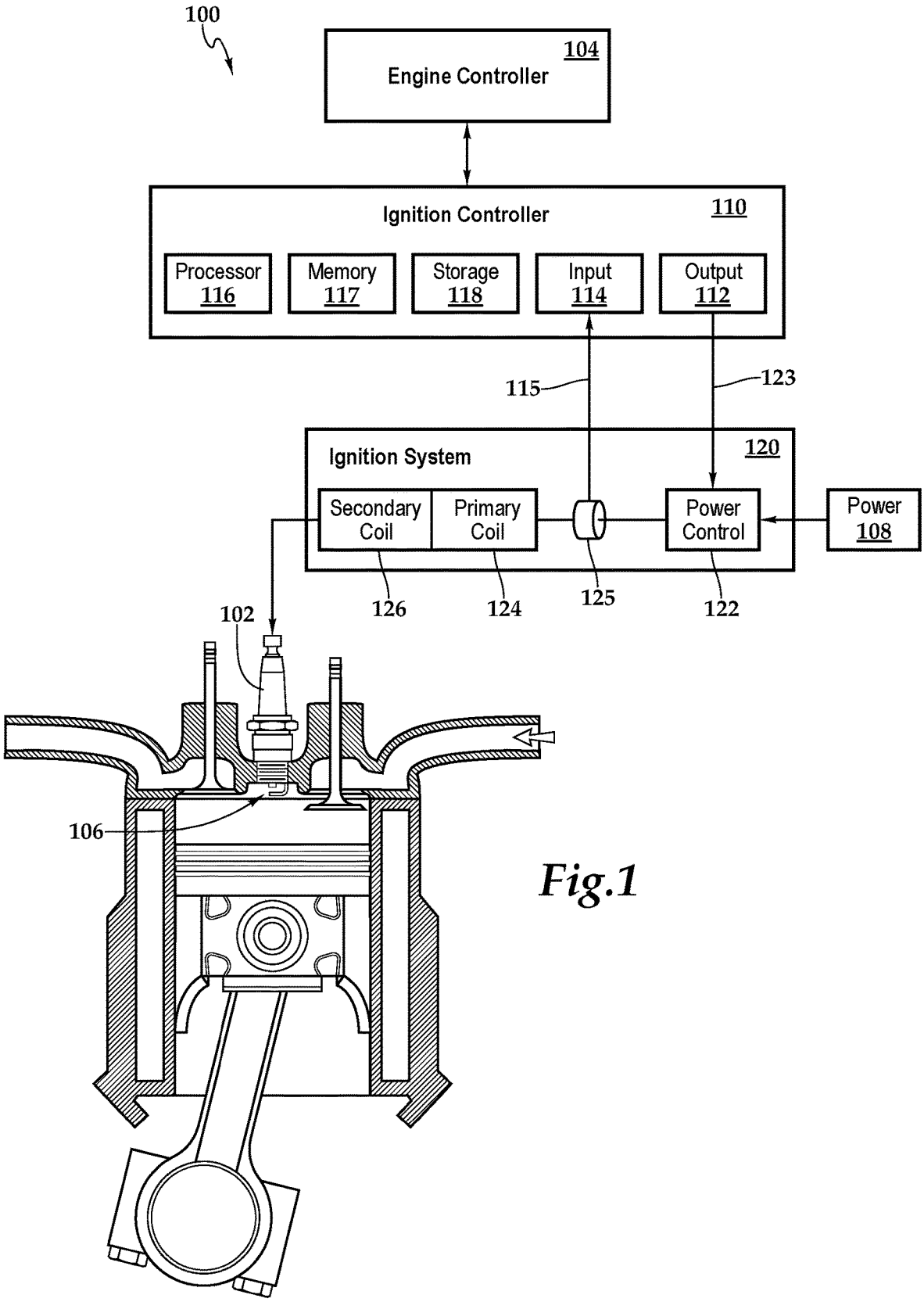
FIG. 1 is a schematic diagram that shows an example engine control system.

FIG. 1 is a schematic diagram that shows an example engine control system 100 for a reciprocating engine. In some implementations, the system 100 can be used for determining and modifying the response behavior of a spark plug 102. An engine controller 104, such as an Engine Control Module (ECM), communicates with an ignition controller 110, used to control ignition of the spark plug 102 and measure the spark plug's 102 behavior in response to being activated in order to determine if power adjustments and/or re-sparking would be beneficial. By determining the behavior of the spark plug 102, the engine controller 104 can monitor, diagnose, control, and/or predict the performance of the spark plug 102.

The spark plug 102 of example ignition control system 100 includes electrodes 106 between which a spark is generated. The spark plug 102 is driven by an ignition system 120. A power controller 122 provides power from a power source 108 (e.g., an electric starter battery or regulated power supply) to a primary ignition coil 124 based on signals received over a control bus 123. The primary coil drives a secondary ignition coil 126 that steps up the voltage to levels that will cause the spark plug 102 to produce a spark across the electrodes 106. By controlling the amount of power provided to the primary coil 124, the energy of the spark can be controlled.

The ignition controller 110 includes an output module 112 that provides control signals to the control bus 123 that control the delivery of power to the primary coil 124, and as such, control the temperature of the spark at the electrodes 106. The ignition controller 110 also includes an input module 114 (e.g., an analog to digital converter) that is configured to receive feedback signals from a feedback bus 115. The feedback signals are provided by a current sensor 125 (e.g., current transducer) that is configured to sense the amplitude of current that flows from the power controller 122 to the primary ignition coil 124.

The ignition controller 110 monitors the feedback signals (e.g., primary coil current amplitude) to determine when the spark plug 102 starts and/or ends its spark. Generally speaking, by determining the operational behavior of the spark plug 102 under various actuation stimuli, the ignition controller 110 can determine how it may reduce power delivery to the primary ignition coil 124 (e.g., to reduce spark temperature and temperature-induced electrode erosion, to diagnose malfunctions), determine the duration of the spark (e.g., to calibrate spark timing, diagnose malfunctions, predict malfunctions), and/or determine premature spark end (e.g., blowout, to trigger a re-spark within the same piston stroke, to diagnose fuel problems, to calibrate spark plug power delivery).

The ignition controller 110 can be used for the operations described herein according to one implementation. The ignition controller 110 includes a processor 116, a memory 117, and a storage device 118. The processor 116 is capable of processing instructions for execution within the ignition system 110. In one implementation, the processor 116 can be a field-programmable gate array (FPGA) processor. For example, with the advent of very fast FPGAs, it is possible to look carefully at the input module 114 and detect very small variations in current waveforms at very fast clock rates.

In another implementation, the processor 116 can be a single-threaded processor. In another implementation, the processor 116 can be a multi-threaded processor. In some implementations, the processor 116 can be capable of processing instructions stored in the memory 117 or on the storage device 118 to collect information from the current sensor 125, and provide control signals to the power controller 122.

The memory 117 stores information within the ignition controller 110. In some implementations, the memory 117 can be a computer-readable medium. In some implementations, the memory 117 can be a volatile memory unit. In some implementations, the memory 117 can be a non-volatile memory unit.

The storage device 118 is capable of providing mass storage for the ignition controller 110. In one implementation, the storage device 118 is a computer-readable medium. In various different implementations, the storage device 118 may be non-volatile information storage unit (e.g., FLASH memory).

The output module 112 provides control signal output operations for the power controller 122. The output module 112 provides actuation control signals (e.g., pulse width modulated, PWM, driver signals) to a driver which drives the primary ignition coil 124. For example, the power controller 122 can include field effect transistors (FETs) or other switching devices that can convert a logic-level signal from the output module 112 to a current and/or voltage waveform with sufficient power to drive the primary ignition coil 124 of the ignition system 120.

The features described herein can be implemented in digital electronic circuitry, or in computer hardware, firmware, software, or in combinations of them. The apparatus can be implemented in a computer program product tangibly embodied in an information carrier, e.g., in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

Figure 2:
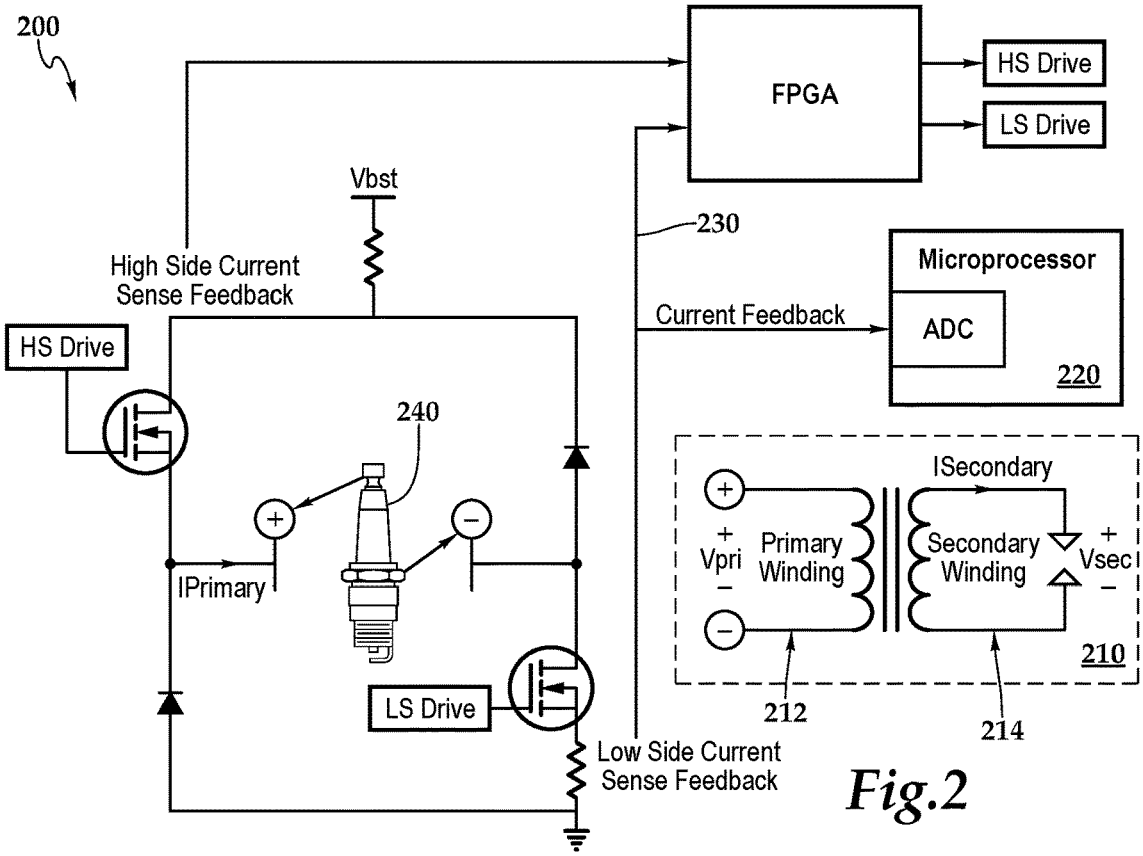
FIG. 2 is a schematic diagram of an example ignition control system.

FIG. 2 is a schematic diagram of an example ignition control system 200. In some embodiments, the ignition control system 200 can be the ignition control system 110 of the example engine control system 100 of FIG. 1.

The ignition control system 200 contains an electronics driver that precisely delivers and controls the electrical voltage and current to a primary winding 212 of an ignition coil 210 using a Pulse Width Modulation (PWM) switching topology or a capacitive discharge topology. The ignition control system 200 also contains current feedback circuits that aid in the control of the voltage application and the current flow through the primary winding 212 (e.g., primary ignition coil) of the ignition coil 210. The ignition control system 200 includes a processor 220 that is able to process the feedback of current flowing through the primary winding 212 of the ignition coil 210. The processor 220 executes algorithms that are configured to determine, from feedback signals received over a primary winding current feedback bus 230, the operating state of a spark plug 240 that is connected to the secondary winding of the ignition coil 210. When the primary winding current feedback is processed as will be discussed further below, one can infer breakdown voltage of the spark plug 240, observe the precise time occurrence of ionization of the spark plug 240, sense a spark blowout condition, and/or sense an end of spark condition.

The inferred spark plug breakdown voltage can be used as a prognostic in engine applications to monitor wear of the spark plug 240. As the spark plug 240 wears, the size of a gap between the electrodes of the spark plug 240 grows, and the breakdown voltage of the spark plug 240 increases as a result. When the inferred spark plug breakdown voltage exceeds a predetermined value, the processor 220 can provide an alarm signal to indicate that it is time to replace the spark plug 240 in order to prevent unplanned engine down time.

In previous embodiments, the primary winding would be driven with relatively higher energy levels in order to ensure that sufficient voltage and current were provided to create spark plug breakdown or ionization under all operating conditions. The higher energy levels exhibited by such previous methods can result in accelerated electrode wear at the spark plug, and this can lead to increased maintenance cost and increased engine down time. By contrast, the current feedback algorithms executed by the processor 220 are configured to very precisely sense the instant that spark plug breakdown has occurred. This ability allows for an immediate reduction in energy applied to the primary winding 212 and to the spark plug 240 attached to a secondary winding 214 (e.g., secondary ignition coil) of the ignition coil 210, thereby reducing electrode wear and increasing the service life of the spark plug 240. Additionally the spark plug breakdown time can be used to calibrate the timing of ignition driver firing to improve engine and combustion performance.

The processor 220 is also configured to sense if the spark at the electrodes of the spark plug 240 are blown out or extinguish. Sensing such blowout conditions allows ignition controller 200 to modify PWM switching of power to the primary winding 212 so that an additional spark can be initiated in order to prevent engine misfire or reduced combustion performance. Additionally, sensing the blowout condition can be used to modify/calibrate ignition driver firing and/or energy profiles in order to avoid misfire and blowout conditions.

The processor 220 is also configured to sense the end of spark instant. In some implementations, detection of the end of spark can be used to calibrate engine combustion and performance. In some implementations, precise detection of the spark start and end can be used in processes for controlling and optimizing the amount of energy delivered to the spark plug. Detection of end of spark is discussed further in the description of FIGS. 5 and 6.

Figure 3:
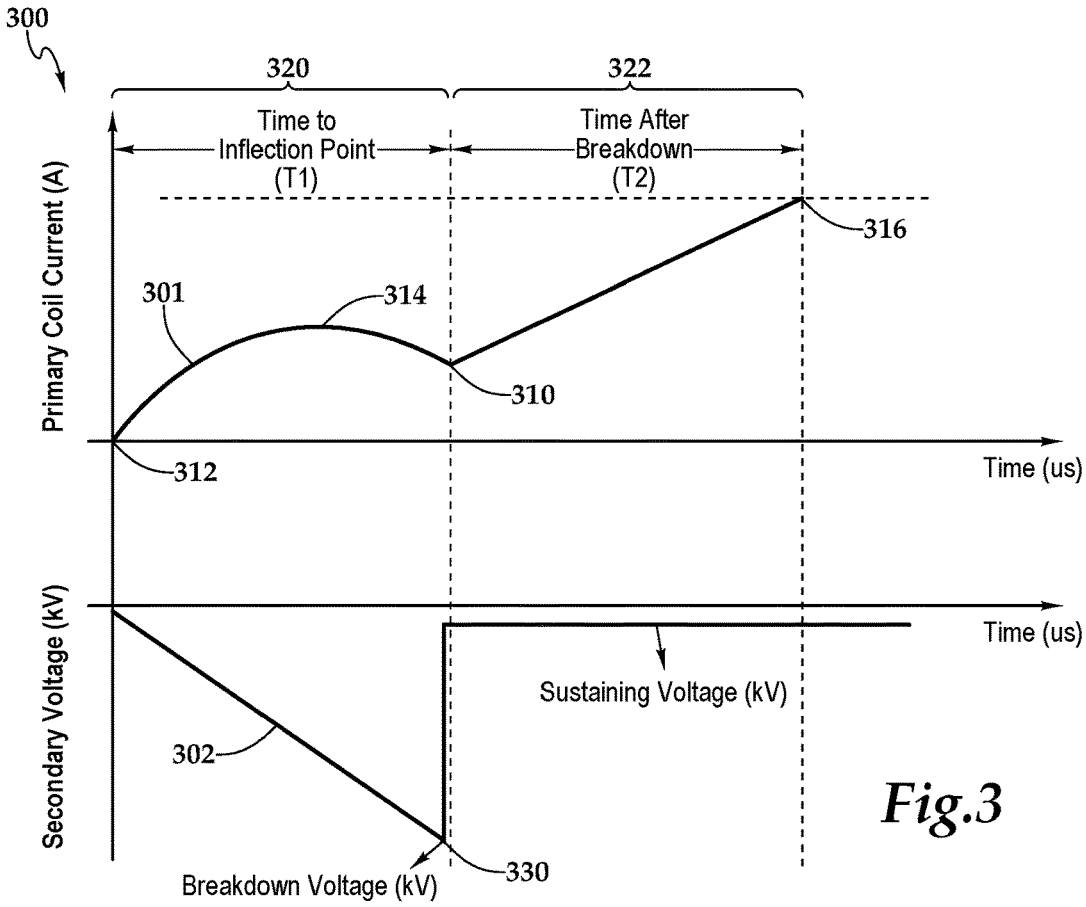
FIG. 3 is a graph of example primary coil current and example secondary coil voltage over time.

FIG. 3 is a graph 300 of example primary coil current 301 and example secondary coil voltage 302 over time. In some implementations, the primary coil current 301 can represent the current on the primary ignition coil 124 of the example engine control system 100 of FIG. 1 or the current on the primary winding 212 of the example ignition control system 200 of FIG. 2. In some implementations, the secondary coil voltage 302 can represent the voltage produced by the secondary ignition coil 126 or the voltage produced by the secondary winding 214.

FIG. 3 the primary coil current 301 is an example of primary coil current amplitude during the creation of spark. An inflection point 310 in the primary coil current 301 occurs when a spark is generated as a result of ionization of the spark plug gap in response to a high voltage generated by the secondary coil winding. When the spark occurs, the secondary of the transformer is electrically shorted, resulting in substantially only the leakage inductance limiting the rate of rise of current. The leakage inductance is generally about an order of magnitude less than the primary inductance, hence the di/dt with only the leakage inductance is much higher. The inflection point 310 occurs at the instant that the spark plug gap ionizes. In the illustrated example, the primary coil current 310 rises (e.g., from zero) at a starting point 312 to a peak 314 and then starts to drop again until the inflection point 310. The primary coil current 301 begins to rise again after the inflection point 310. The period of time (T1) between the starting point 312 and the inflection point 310, is represented as a time period 320 (T1). The period of time (T2) between the inflection point 310 and an ending point 316, is represented as a time period 322. In some implementations, the starting point 312 can be determined by monitoring the primary coil current 301. For example, when current sensed by the current sensor 125 rises from about zero amps to above a predetermined minimum current threshold value (e.g., comparator operation). This signal is then fed back (e.g., to an FPGA) to control the current. In some implementations, the starting point 312 can be determined by monitoring signals from an engine controller (e.g., triggered by a signal from the output module 112 to the power controller 122). In some implementations, the ending point 316 can represent an end of spark event.

The inflection point 310 (e.g., change in the rate of current rise, di/dt change) is that the impedance of the spark plug gap changes at breakdown or ionization, for example, as seen from the secondary winding voltage and represented as a point 330. Prior to breakdown or ionization 330, the spark plug gap behaves like a very high impedance open circuit to the secondary winding. As discussed above, when the spark occurs, the secondary of the transformer is electrically shorted, resulting in substantially only the leakage inductance limiting the rate of rise of current. The leakage inductance is generally about an order of magnitude less than the primary inductance, hence the di/dt with only the leakage inductance is much higher. After breakdown or ionization 330, the spark plug gap exhibits a low impedance that approximates a short circuit. As is well known in the art, when two mutually coupled windings (e.g., as in a transformer such as an ignition coil) are shorted on the secondary winding, the current in the primary winding can rise quickly as the primary and secondary winding magnetizing inductances no longer inhibit current rise. This is because the short on the secondary winding effectively bypasses the magnetizing inductances. After ionization, only a much lower primary to secondary winding leakage inductance inhibits the primary current rise, which is exhibited as the inflection point 310 and the increased primary winding di/dt during the period of time 322.

Figure 4:
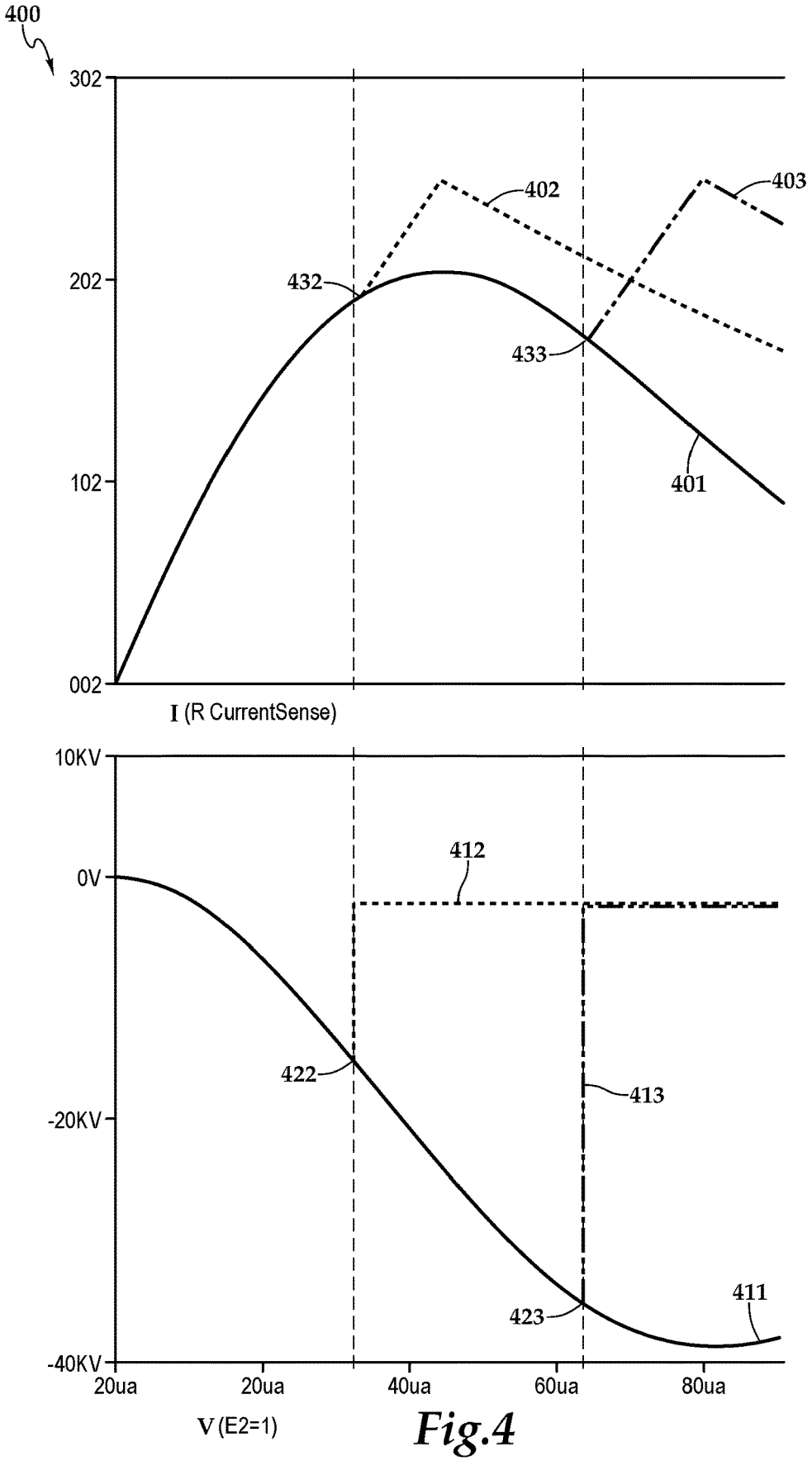
FIG. 4 is a graph of three different example primary currents resulting from three different example secondary voltage and spark gap conditions.

FIG. 4 is a graph 400 of three different example primary coil currents 401, 402, and 403, resulting from three different example secondary coil voltages and spark gap conditions 411, 412, and 413. In some implementations, the primary coil current 401-403 can represent currents on the primary ignition coil 124 of the example engine control system 100 of FIG. 1 or currents on the primary winding 212 of the example ignition control system 200 of FIG. 2. In some implementations, the secondary coil voltages 411, 412, and 413 can represent the voltage produced by the secondary ignition coil 126 or the voltage produced by the secondary winding 214.

When the breakdown voltage is low, as illustrated by the secondary coil voltage 412 (e.g., 15 kV in the illustrated example), a secondary inflection point 422 associated with breakdown occurs early (e.g., approximately 35 usec in the illustrated example). The secondary inflection point 422 is observable as a primary inflection point 432 in the primary coil current 402. When the breakdown voltage is high, as illustrated by the secondary coil 413 (e.g., 35 kV in the illustrated example), a secondary inflection point 423 associated with the breakdown occurs later (e.g., approximately 65 usec in the illustrated example). The secondary inflection point 423 is observable as a primary inflection point 433 in the primary coil current 403. If there is no breakdown condition (also known as open circuit), as shown by the secondary coil voltage 411, then there is no abrupt di/dt change or inflection point in the primary winding current 401.

The amounts of time taken for the primary coil currents 402 and 403 to reach the inflection point correlates with the breakdown voltage. As the breakdown voltages increase, the amounts of times that the primary currents 402, 403 take to reach the inflection points 432, 433 increase (e.g., about 35 usec to reach the inflection point 432, about 65 usec to reach the inflection point 433). A processor, such as the processor 116 of the example ignition controller 110 of FIG. 1, is able to use feedback from the primary currents 402, 403 to determine the amounts of time between the start of the primary coil currents 401-403 and the times at which the inflection points 432, 433 occur. In some implementations, the processor can perform a table lookup operation or perform a mathematical algorithm (e.g., linear regression, predictive analytics) to correlate the inflection point times to actual spark plug breakdown voltages.

Figure 5:
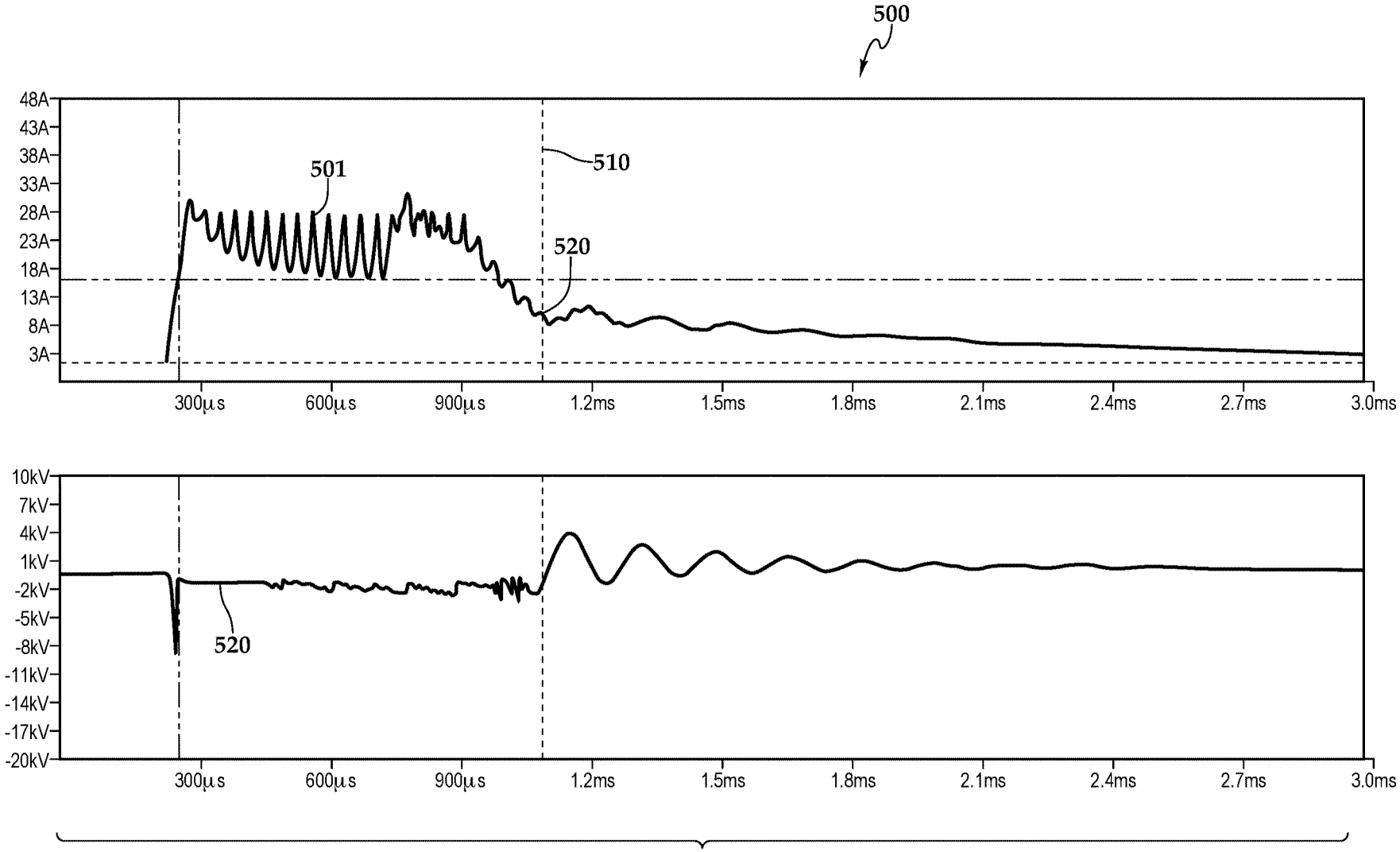
FIG. 5 is a graph of example primary coil current and example secondary coil voltage that includes a spark extinguish event.

FIG. 5 is a graph 500 of example primary coil current 501 and example secondary coil voltage 502 that includes a spark extinguish event. In some implementations, the primary coil current 501 can represent the current on the primary ignition coil 124 of the example engine control system 100 of FIG. 1 or the current on the primary winding 212 of the example ignition control system 200 of FIG. 2. In some implementations, the secondary coil voltage 502 can represent the voltage produced by the secondary ignition coil 126 or the voltage produced by the secondary winding 214.

The primary coil current 501 can be analyzed to identify the end of spark time, or spark extinguish occurrence. When a spark extinguishes, the impedance of the spark plug gap significantly increases. Whereas a spark event is similar to an electrical short between the electrodes of a spark plug, the end of spark causes the spark plug to act as an open circuit. The end of the spark event removes the short circuit from the ignition coil secondary winding and results in a much slower rate of change (e.g., slope, di/dt) in in the primary coil current 501.

In the illustrated example, the end of spark occurs at approximately 1000 usec (represented by time 510). The primary coil current 501 drops with a negative rate of change of about 25 A during the 100 usec preceding the end of spark 510, and becomes more stable with a less negative rate of change (e.g., a di/dt that is relatively closer to zero) after the end of spark 510. The slope change in the primary coil current 501 associated with the ending of the spark is identifiable as an inflection point 520.

In some implementations, detection of the end of spark can be used to calibrate engine combustion and performance. For example, the end of spark can be used to determine the duration of a spark. The inferred spark duration can be used as a prognostic in engine applications to monitor wear of a spark plug, such as the example spark plug 102 of FIG. 1. As the spark plug 102 wears, the size of the gap between the electrodes 106 grows, and the breakdown voltage of the spark plug 102 increases as a result, which can shorten the duration of spark. When the inferred spark duration drops below a predetermined value, the processor 116 can provide an alarm signal to indicate that it is time to replace the spark plug 102 in order to prevent unplanned engine down time.

Figure 6:
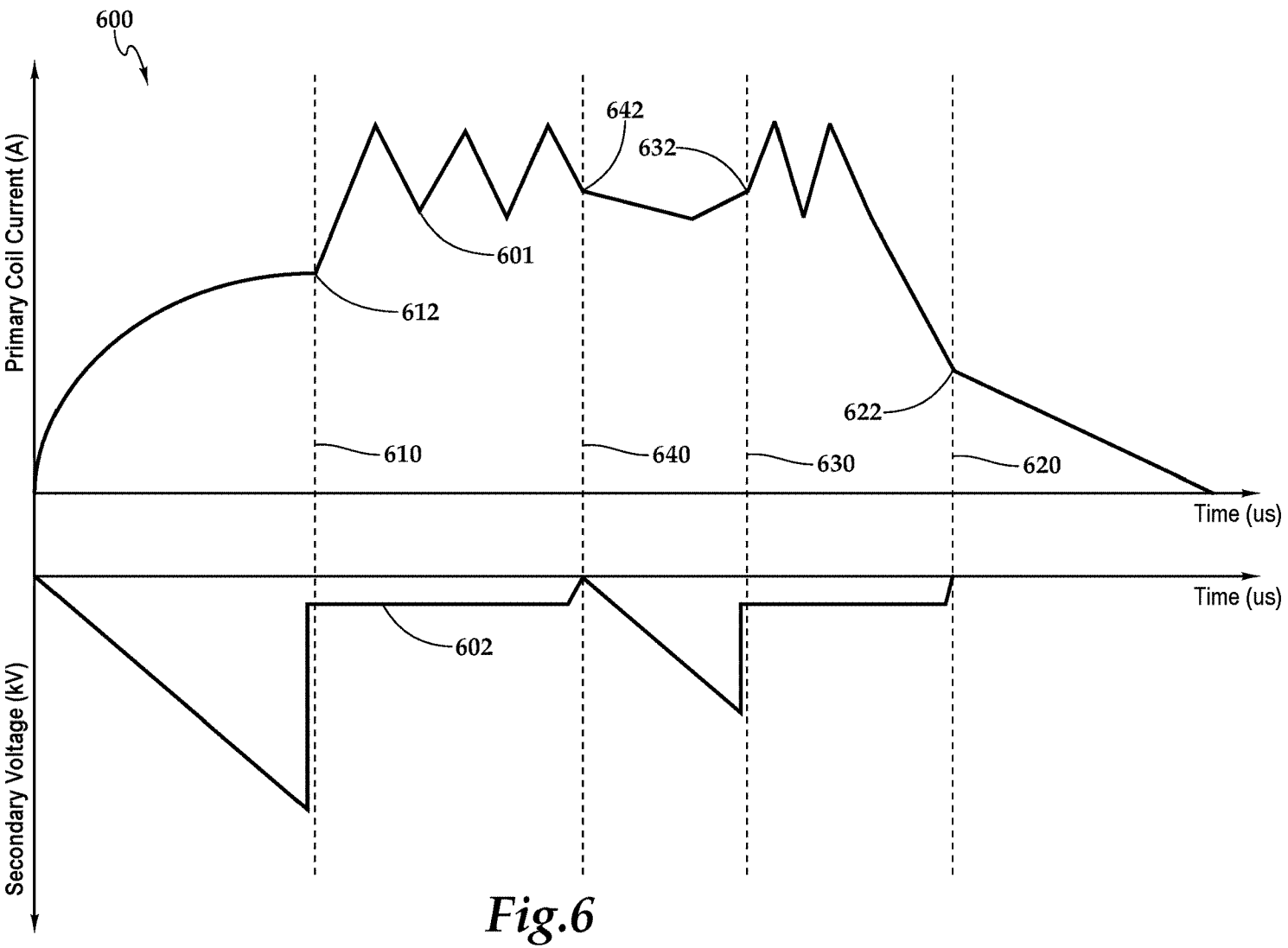
FIG. 6 is a graph of example primary coil current and example secondary coil voltage during a blowout event.

FIG. 6 is a graph 600 of example primary coil current 601 and example secondary coil voltage 602 during a blowout event. In some implementations, the primary coil current 601 can represent the current on the primary ignition coil 124 of the example engine control system 100 of FIG. 1 or the current on the primary winding 212 of the example ignition control system 200 of FIG. 2. In some implementations, the secondary coil voltage 602 can represent the voltage produced by the secondary ignition coil 126 or the voltage produced by the secondary winding 214.

The primary coil current 601 can be analyzed to identify when a spark is blown out (e.g., extinguished), for example, due to turbulence in the combustion chamber or fuel issues. In the illustrated example, a start of spark of a spark plug spark occurs at a time represented by 610 and can be detected by identifying an inflection point 612. An end of spark of the spark plug spark occurs at a time represented by 620 and can be detected by identifying an inflection point 622.

During a blowout condition (e.g., extinguishment), the spark plug gap impedance changes from a short circuit exhibited during sparking, to an open circuit exhibited after blowout. This change in impedance loading on the ignition coil secondary winding results in a reduction the rate of change (e.g., slope) in the primary coil current 601.

In the illustrated example, extinguishment of the spark plug spark occurs at a time represented by 640 and can be detected by identifying an inflection point 642. There is change in the slope of the primary coil current 601 associated with the blowout condition (e.g., extinguishment). For example, prior to the extinguishing at 640, the di/dt looks similar to the di/dt between a time represented by 630 and 620. Between 640 and 630 the primary coil current 601 exhibits a long duration for the same current drop (e.g., smaller slope), this is an indication that the spark is extinguished and the impedance is no longer similar to a short; rather, the impedance is similar to that of an open coil (e.g., a small di/dt). The point where the rate of change in primary coil current 601 changes slope as a result of re-striking the spark is identified as the inflection point 632.

In some implementations, spark extinguishment and end of spark can be distinguished from each other based on expected or observed spark durations under normal operating conditions. For example, the example ignition controller 110 of FIG. 1 can be configured to provide power to the primary coil 124 for 1000 usec for a nominal combustion cycle, and when an inflection point is detected sooner than say for example 900 usec, that inflection point can be identified as being indicative of a premature extinguishment of the spark, possibly due to blowout.

In some implementations, detection of blowout can be used to modify operation of the spark plug. For example, when a spark is extinguished prematurely, the fuel in the combustion chamber may remain partly or completely uncombusted. Uncombusted fuel can result in reductions in engine power, fuel efficiency, and exhaust cleanliness. By detecting the blowout condition, the ignition controller 110 can provide a second (e.g., possibly stronger) pulse of energy during the same combustion stroke in an attempt to re-ignite the unspent fuel. In another example, the ignition controller may detect a predetermined threshold frequency or number of blowout events and be configured to respond by increasing the amount of energy provided for future sparks (e.g., poor quality fuel may require higher spark temperatures to avoid missed strokes). The ignition controller may also be configured to reduce the amount of energy provided until a predetermined threshold frequency or number of blowout events start to be detected. For example, unusually infrequent misses may suggest that the spark energy may be higher than is actually needed, and can be reduced to enhance plug wear (e.g., a tank of bad fuel might leave the ignition controller with an energy configuration that is higher than is needed for a subsequent tank of better quality fuel).

Figure 7:
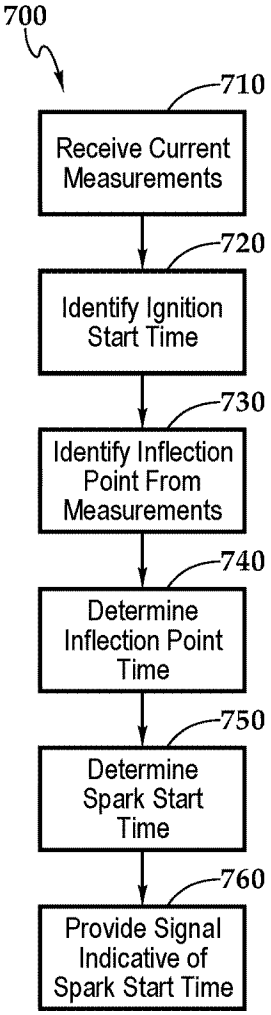
FIG. 7 is flow chart that shows an example of a process for determining the response of a spark plug.

FIG. 7 is flow chart that shows an example of a process 700 for determining the response of a spark plug. In some implementations, the process 700 can be performed by the engine controller 104 and/or the ignition controller 110 of the example engine control system 100 of FIG. 1, and/or by the processor 220 of the example ignition controller 200 of FIG. 2.

At 710 a collection of measurements are received. The measurements are of electric current amplitude in a primary winding of an engine ignition system comprising the primary winding and a spark plug. In some implementations, the measurements can be received by sensing, by an electric current sensor, the collection of measurements. For example, the ignition controller 110 includes the input module 114, which is configured to receive feedback signals from the current sensor 125, which is configured to sense the amplitude of current that flows from the power controller 122 to the primary ignition coil 124.

At 720, an ignition start time is identified. For example, the ignition controller 110 can sense a change in the rate of the current flowing through the primary ignition coil 124 as an indication that a new ignition cycle is starting. In another example, the ignition controller 110 may be responsible for starting the ignition cycle, and would be able to identify the start of the ignition cycle inherently.

At 730, an inflection point is identified based on the plurality of measurements. In some implementations, the inflection point can be identified by determining a first rate of change in electric current amplitude in the primary winding, determining a second rate of change in electric current amplitude in the primary winding that is adjacent to and different from the first rate of change, identifying a transition point based on the plurality of measurement where the first rate of change meets the second rate of change, and providing the identified transition point as the inflection point. For example, the ignition controller 110 can determine a distinct change in the slope of the primary coil current 301 (e.g., negative slope to positive slope) and identify the change as the inflection point 310.

At 740, an inflection point time representative of a time at which the identified inflection point occurred is determined. For example, the ignition controller 110 can determine that the inflection point 310 occurred at time T1 (e.g., 50 usec) after ignition start.

At 750, a spark start time is determined based on an amount of time between the ignition start time and the inflection point time. For example, continuing the previous example, since the inflection point 310 occurred at time T1 (e.g., 50-100 usec) after ignition start, the ignition controller 110 can determine that the difference between ignition start time and inflection point time is T1 (e.g., 50-100 usec).

At 760, a signal indicative of the spark start time is provided. For example, the processor 116 can set a variable to represent the spark start time in the memory 117, or store the spark start time in the storage 118, or provide the spark start time to the output module 112, and/or provide the spark start time to the engine controller 104.

In some implementations, the process 700 can also include determining a spark plug breakdown voltage based on the spark start time, and providing a signal indicative of the spark plug breakdown voltage. For example, the ignition controller 110 and/or the engine controller 104 can perform a table lookup based on the spark start time to determine a corresponding spark plug breakdown voltage. In another example, the ignition controller 110 and/or the engine controller 104 can execute an algorithm or a mathematical model to calculate the spark plug breakdown voltage based on the spark start time.

In some implementations, the process 700 can also include providing a first amount of energy to the primary winding, wherein the ignition start time corresponds to the start of providing the first amount of energy, determining a second amount of energy based on the spark start time that is different from the first amount of energy, providing the second amount of energy to the primary winding, and sparking the spark plug based on the second amount of energy. In some implementations, the second amount of energy can be less than the first amount of energy. For example, the ignition controller 110 can be initially configured to provide switch the power controller 122 on for 175 usec to power the primary coil 122 from the power source 108. After one or more combustion cycles based on the initial configuration, the ignition controller 110 can determine that the spark start time happens at about 45 usec, which is about 130 usec less than the duration of power that is initially being used. Since excess power can cause accelerated wear of the electrodes 106, the ignition controller 110 can respond by reconfiguring itself to provide a shorter pulse of power, and therefore less energy, from the power source 108 to the primary coil 124. For example, the ignition controller 110 can use current feedback signals from the current sensor to shorten the ignition pulse from 175 usec to a duration ranging from about 25 usec to about 1500 usec.

In some implementations, the process 700 can also include determining that the spark start time has exceeded a predetermined threshold time value, and provide a signal indicative of a condition in which the spark plug is to be replaced. For example, the spark plug 102 may take 50 usec to spark under nominal conditions, but as the electrodes 106 wear the amount of delay before the start of spark can expand. The length of spark start time can be correlated to a table or algorithm that can estimate the amount of useful service life left in the spark plug 102 and provide an alarm or other indication to operators or service personnel to indicate that the spark plug 102 should be replaced. Without such an indication, a worn spark plug may remain in use to cause reduced engine performance and/or fail unexpectedly to cause unplanned service downtime.

In some implementations, the process 700 can also include identifying a second inflection point based on the plurality of measurements, determining that a spark developed by the spark plug has been extinguished based on the second inflection point, and provide an extinguishment signal indicative of a condition in which the spark plug spark has been extinguished. For example, the spark plug 102 may take 50 usec to spark under nominal conditions and the spark may normally end at 500 usec. The ignition controller 110 can identify an inflection point that occurred at a point that is after the start of spark (e.g., 50 usec) but before the expected end of spark (e.g., 500 usec). Such an inflection point can be indicative of the spark being extinguished (e.g., blown out).

In some implementations, the process 700 can include providing an amount of energy to the primary winding in response to the extinguishment signal, and re-sparking the spark plug based on the amount of energy. For example, when a spark is blown out, the fuel in a combustion chamber may be incompletely combusted which can cause a loss in engine performance and/or an increase in exhaust emissions. In response to determining that a spark blowout condition has occurred, the ignition controller 110 can respond by providing an additional pulse of power to the primary ignition coil 124 during the same combustion stroke to re-spark the spark plug 102 in an effort to combust the unspent fuel.

In some implementations, the process 700 can also include identifying a second inflection point based on the plurality of measurements, determining that an end of spark event has occurred based on the second inflection point, and provide an end of spark signal indicative of a condition in which the spark plug spark has been extinguished. For example, the ignition controller 110 can identify the inflection point 520 of the example primary coil current 501 as an indicator that the spark has ended and provide a signal (e.g., to the engine controller 104) that the spark has been extinguished.

Although a few implementations have been described in detail above, other modifications are possible. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method comprising:

receiving a plurality of measurements of electric current amplitude in a primary winding of an engine ignition system comprising the primary winding and a spark plug;

identifying an ignition start time;

identifying an inflection point based on the plurality of measurements;

determining an inflection point time representative of a time at which the identified inflection point occurred;

determining a spark start time based on an amount of time between the ignition start time and the inflection point time;

providing a signal indicative of the spark start time;

identifying a second inflection point based on the plurality of measurements;

determining that a spark developed by the spark plug has been extinguished based on the second inflection point; and, controlling engine ignition based on at least one of the determined spark start time and a condition in which the spark plug has been extinguished.

2. The method of claim 1, wherein controlling engine ignition further comprises:

measuring, by an electric current sensor, the plurality of measurements; and providing, by the electric current sensor, the measured plurality of measurements as the received plurality of measurements.

3. The method of claim 1, wherein controlling engine ignition further comprises:

determining a spark plug breakdown voltage based on the spark start time; and, providing a signal indicative of the spark plug breakdown voltage.

4. The method of claim 1, wherein controlling engine ignition further comprises:

providing a first amount of energy to the primary winding, wherein the ignition start time corresponds to the start of providing the first amount of energy;

determining a second amount of energy based on the spark start time that is different from the first amount of energy;

providing the second amount of energy to the primary winding; and sparking the spark plug based on the second amount of energy.

5. The method of claim 4, wherein the second amount of energy is less than the first amount of energy.

6. The method of claim 1, wherein controlling engine ignition further comprises:

determining that the spark start time has exceeded a predetermined threshold time value; and provide a signal indicative of a condition in which the spark plug is to be replaced.

7. The method of claim 1, wherein controlling engine ignition further comprises:

providing an amount of energy to the primary winding based on a condition in which the spark plug spark has been extinguished; and, re-sparking the spark plug based on the amount of energy.

8. The method of claim 1, further comprising:

identifying a second inflection point based on the plurality of measurements; and determining that an end of spark event has occurred based on the second inflection point;

wherein controlling engine ignition further comprising comprises providing an end of spark signal indicative of a condition in which the spark plug spark has been extinguished.

9. The method of claim 1, wherein identifying an inflection point based on the plurality of measurements comprises:

determining a first rate of change in electric current amplitude in the primary winding;

determining a second rate of change in electric current amplitude in the primary winding that is adjacent to and different from the first rate of change;

identifying a transition point based on the plurality of measurement where the first rate of change meets the second rate of change; and providing the identified transition point as the inflection point.

10. An ignition controller comprising:

an input;

an output;

memory storing instructions that are executable; and one or more processing devices to execute the instructions to perform operations comprising:

receiving, at the input, a plurality of measurements of electric current amplitude in a primary winding of an engine ignition system comprising the primary winding and a spark plug;

identifying an ignition start time;

identifying an inflection point based on the plurality of measurements;

determining an inflection point time representative of a time at which the identified inflection point occurred;

determining a spark start time based on an amount of time between the ignition start time and the inflection point time;

providing, at the output, a signal indicative of the spark start time;

identifying a second inflection point based on the plurality of measurements;

determining that a spark developed by the spark plug has been extinguished based on the second inflection point; and, controlling engine ignition based on at least one of the determined spark start time and a condition in which the spark plug has been extinguished.

11. The ignition controller of claim 10, the operations further comprising:

measuring, by an electric current sensor, the plurality of measurements; and providing, by the electric current sensor, the measured plurality of measurements as the received plurality of measurements.

12. The ignition controller of claim 10, wherein controlling engine ignition further comprising comprises:

determining a spark plug breakdown voltage based on the spark start time; and, providing a signal indicative of the spark plug breakdown voltage.

13. The ignition controller of claim 10, wherein controlling engine ignition further comprising comprises:

providing a first amount of energy to the primary, wherein the ignition start time corresponds to the start of providing the first amount of energy;

determining a second amount of energy based on the spark start time that is different from the first amount of energy;

providing the second amount of energy to the primary winding; and sparking the spark plug based on the second amount of energy.

14. The ignition controller of claim 13, wherein the second amount of energy is less than the first amount of energy.

15. The ignition controller of claim 10, wherein controlling engine ignition further comprising comprises:

determining that the spark start time has exceeded a predetermined threshold time value; and provide a signal indicative of a condition in which the spark plug is to be replaced.

16. The ignition controller of claim 10, wherein controlling engine ignition further comprising comprises:

providing an amount of energy to the primary winding based on a condition in which the spark plug spark has been extinguished; and, re-sparking the spark plug based on the amount of energy.

17. The ignition controller of claim 10, wherein controlling engine ignition further comprising comprises:

identifying a second inflection point based on the plurality of measurements;

determining that an end of spark event has occurred based on the second inflection point; and, provide an end of spark signal indicative of a condition in which the spark plug spark has been extinguished.

18. The ignition controller of claim 10, wherein identifying an inflection point based on the plurality of measurements comprises:

determining a first rate of change in electric current amplitude in the primary winding;

determining a second rate of change in electric current amplitude in the primary winding that is adjacent to and different from the first rate of change;

identifying a transition point based on the plurality of measurement where the first rate of change meets the second rate of change; and providing the identified transition point as the inflection point.

19. An engine system comprising:

an engine;

an engine ignition system comprising a primary winding and a spark plug; and an ignition controller comprising:

an input;

an output;

memory storing instructions that are executable; and one or more processing devices to execute the instructions to perform operations comprising:

receiving, at the input, a plurality of measurements of electric current amplitude in a primary winding of an engine ignition system comprising the primary winding and a spark plug;

identifying an ignition start time;

identifying an inflection point based on the plurality of measurements;

determining an inflection point time representative of a time at which the identified inflection point occurred;

determining a spark start time based on an amount of time between the ignition start time and the inflection point time;

providing, at the output, a signal indicative of the spark start time;

identifying a second inflection point based on the plurality of measurements;

determining that a spark developed by the spark plug has been extinguished based on the second inflection point; and, controlling the engine ignition system based on at least one of the determined spark start time and a condition in which the spark plug has been extinguished.

20. The engine system of claim 19, wherein controlling the engine ignition system further comprises:

measuring, by an electric current sensor, the plurality of measurements: and providing, by the electric current sensor, the measured plurality of measurements as the received plurality of measurements.

21. The engine system of claim 19, wherein controlling the engine ignition system further comprises:

determining a spark plug breakdown voltage based on the spark start time; and, providing a signal indicative of the spark plug breakdown voltage.

22. The engine system of claim 19, wherein controlling the engine ignition system further comprises:

providing a first amount of energy to the primary winding, wherein the ignition start time corresponds to the start of providing the first amount of energy;

determining a second amount of energy based on the spark start time that is different from the first amount of energy;

providing the second amount of energy to the primary winding; and sparking the spark plug based on the second amount of energy.

23. The engine system of claim 22, wherein the second amount of energy is less than the first amount of energy.

24. The engine system of claim 19, wherein controlling the engine ignition system further comprises:

determining that the spark start time has exceeded a predetermined threshold time value; and provide a signal indicative of a condition in which the spark plug is to be replaced.

25. The engine system of claim 19, wherein controlling the engine ignition system further comprises:

providing an amount of energy to the primary winding based on a condition in which the spark plug spark has been extinguished; and, re-sparking the spark plug based on the amount of energy.

26. The engine system of claim 19, wherein controlling the engine ignition system further comprises:

identifying a second inflection point based on the plurality of measurements;

determining that an end of spark event has occurred based on the second inflection point; and, provide an end of spark signal indicative of a condition in which the spark plug spark has been extinguished.

27. The engine system of claim 19, wherein identifying an inflection point based on the plurality of measurements comprises:

determining a first rate of change in electric current amplitude in the primary winding;

determining a second rate of change in electric current amplitude in the primary winding that is adjacent to and different from the first rate of change;

identifying a transition point based on the plurality of measurement where the first rate of change meets the second rate of change; and providing the identified transition point as the inflection point.

28. A method comprising:

measuring, by an electric current sensor, a plurality of measurements of electric current amplitude in a primary winding of an engine ignition system comprising the primary winding and a spark plug;

receiving, at an input of an ignition controller, the plurality of measurements;

identifying, by the ignition controller, an inflection point based on the plurality of measurements;

determining, by the ignition controller, that a spark developed by the spark plug has been extinguished based on the inflection point; and, activating, based on the determining, an output of the ignition controller to provide an extinguishment signal to service personnel, wherein the extinguishment signal is indicative to service personnel of a condition in which the spark has been extinguished.

29. An ignition controller comprising:

an input;

an output;

an electric current sensor;

memory storing instructions that are executable; and one or more processing devices to execute the instructions to perform operations comprising:

measuring, by the electric current sensor, a plurality of measurements of electric current amplitude in a primary winding of an engine ignition system comprising the primary winding and a spark plug;

receiving, at the input, the plurality of measurements;

identifying an inflection point based on the plurality of measurements;

determining that a spark developed by the spark plug has been extinguished based on the inflection point; and, activating the output, based on the determining, to provide an extinguishment signal to service personnel, wherein the extinguishment signal is indicative to service personnel of a condition in which the spark has been extinguished.

30. An engine system comprising:

an engine;

an engine ignition system comprising a primary winding and a spark plug; and an ignition controller comprising:

an input;

an output;

an electric current sensor;

memory storing instructions that are executable; and one or more processing devices to execute the instructions to perform operations comprising:

measuring, by the electric current sensor, a plurality of measurements of electric current amplitude in a primary winding of an engine ignition system comprising the primary winding and a spark plug;

receiving, at the input, the plurality of measurements;

identifying an inflection point based on the plurality of measurements;

determining that a spark developed by the spark plug has been extinguished based on the inflection point; and, activating, based on the determining, the output to provide an extinguishment signal to service personnel, wherein the extinguishment signal is indicative to service personnel of a condition in which the spark has been extinguished.

31. A method comprising:

providing a first amount of energy to a primary winding of an engine ignition system comprising the primary winding and a spark plug during a combustion cycle;

receiving a plurality of measurements of electric current amplitude in the primary winding;

identifying an ignition start time based on a start of providing the first amount of energy during the combustion cycle;

identifying an inflection point based on the plurality of measurements;

determining an inflection point time representative of a time at which the identified inflection point occurred;

determining a spark start time based on an amount of time between the ignition start time and the inflection point time; and determining a second amount of energy based on the spark start time that is different from the first amount of energy;

providing the second amount of energy to the primary winding during the combustion cycle; and sparking the spark plug during the combustion cycle based on the second amount of energy.

32. An ignition controller comprising:

an input;

an output;

memory storing instructions that are executable; and one or more processing devices to execute the instructions to perform operations comprising:

providing a first amount of energy to a primary winding of an engine ignition system comprising the primary winding and a spark plug during a combustion cycle;

receiving, at the input, a plurality of measurements of electric current amplitude in the primary winding;

identifying an ignition start time based on a start of providing the first amount of energy during the combustion cycle;

identifying an inflection point based on the plurality of measurements;

determining an inflection point time representative of a time at which the identified inflection point occurred;

determining a spark start time based on an amount of time between the ignition start time and the inflection point time; and determining a second amount of energy based on the spark start time that is different from the first amount of energy;

providing the second amount of energy to the primary winding during the combustion cycle; and sparking the spark plug during the combustion cycle based on the second amount of energy.

33. An engine system comprising:

an engine;

an engine ignition system comprising a primary winding and a spark plug; and an ignition controller comprising:

an input;

an output;

memory storing instructions that are executable; and one or more processing devices to execute the instructions to perform operations comprising:

providing a first amount of energy to the primary winding during a combustion cycle;

receiving, at the input, a plurality of measurements of electric current amplitude in the primary winding;

identifying an ignition start time based on a start of providing the first amount of energy during the combustion cycle;

identifying an inflection point based on the plurality of measurements;

determining an inflection point time representative of a time at which the identified inflection point occurred;

determining a spark start time based on an amount of time between the ignition start time and the inflection point time;

determining a second amount of energy based on the spark start time that is different from the first amount of energy;

providing the second amount of energy to the primary winding during the combustion cycle; and sparking the spark plug during the combustion cycle based on the second amount of energy.

* * * * *